US007509198B2

(12) United States Patent
Shull et al.

(10) Patent No.: US 7,509,198 B2
(45) Date of Patent: Mar. 24, 2009

(54) SYSTEM FOR AUTOMATED EXCAVATION ENTRY POINT SELECTION

(75) Inventors: Andrew Shull, Washington, IL (US); Swaroop Sesha Kamala Mannepalli, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/473,136

(22) Filed: Jun. 23, 2006

(65) Prior Publication Data

US 2007/0299590 A1 Dec. 27, 2007

(51) Int. Cl.
*G06F 7/70* (2006.01)

(52) U.S. Cl. ..... 701/50; 172/4.5

(58) Field of Classification Search ..... 342/357.17; 701/50, 49, 213; 172/4.5; 73/149; 37/413
See application file for complete search history.

(56) References Cited

U.S. PATENT DOCUMENTS

| | | | | |
|---|---|---|---|---|
| 5,019,733 | A | 5/1991 | Kano et al. | |
| 5,375,663 | A | 12/1994 | Teach | |
| 5,461,803 | A | 10/1995 | Rocke | |
| 5,631,658 | A | 5/1997 | Gudat et al. | |
| 5,816,335 | A | 10/1998 | Yamamoto et al. | |
| 6,047,227 | A * | 4/2000 | Henderson et al. | 701/50 |
| 6,085,583 | A * | 7/2000 | Cannon et al. | 73/149 |
| 6,108,949 | A | 8/2000 | Singh et al. | |
| 6,112,143 | A * | 8/2000 | Allen et al. | 701/25 |
| 6,167,336 | A | 12/2000 | Singh et al. | |
| 6,191,732 | B1 * | 2/2001 | Carlson et al. | 342/357.06 |
| 6,363,632 | B1 | 4/2002 | Stentz et al. | |
| 6,389,345 | B2 | 5/2002 | Phelps | |
| 6,418,364 | B1 | 7/2002 | Kalafut et al. | |
| 6,655,465 | B2 * | 12/2003 | Carlson et al. | 172/4.5 |
| 6,691,010 | B1 | 2/2004 | Gay | |
| 6,845,311 | B1 | 1/2005 | Stratton et al. | |

FOREIGN PATENT DOCUMENTS

| | | |
|---|---|---|
| EP | 0 452 021 | 10/1991 |
| EP | 1 600 564 | 11/2005 |

* cited by examiner

*Primary Examiner*—Mark Hellner
(74) *Attorney, Agent, or Firm*—Finnegan, Henderson, Farabow, Garrett & Dunner

(57) ABSTRACT

A control system for a machine operating at a worksite is disclosed. The control system has a controller configured to recognize a feature of the worksite from a topographic map of the worksite. The controller is further configured to determine at least one characteristic of the recognized feature, and determine a desired excavation entry point into a surface of the worksite based on the at least one characteristic.

18 Claims, 3 Drawing Sheets

SYSTEM FOR AUTOMATED EXCAVATION ENTRY POINT SELECTION

TECHNICAL FIELD

The present disclosure relates generally to an automated machine control system and, more particularly, to a system for automatically selecting the entry point of a machine's implement during an excavation process.

BACKGROUND

Machines such as, for example, dozers, motor graders, wheel loaders, and other types of heavy equipment are used to perform a variety of tasks. Some of these tasks require very precise and accurate control over operation of the machine that are difficult for an operator to provide. Other tasks requiring removal of large amounts of material can be difficult for an unskilled operator to achieve efficiently. Because of these factors, the completion of some tasks by a completely operator-controlled machine can be expensive, labor intensive, time consuming, and inefficient.

One method of improving the operation of a machine under such conditions is described in U.S. Pat. No. 5,375,663 (the '663 patent) issued to Teach on Dec. 27, 1994. The '663 patent describes an earthmoving apparatus and method for grading a tract of land to a desired finish contour. The earth moving apparatus has a blade of known width for cutting and filling soil. Vertical blade movement and the x and y position of the earthmoving apparatus are continually detected by sensors as the earthmoving apparatus traverses the tract of land. An ultrasonic transmitter and receiver detects elevation of the soil to provide updated soil elevation information. A computer uses this information to generate a contour map of the tract of land with fill and cut lines thereon that will produce the desired finish contour. The computer continuously modifies the contour map to reflect changes in the topography of the tract of land as the earthmoving apparatus proceeds with the grading process. In addition, the computer generates an elevation error based on the contour map and a detected position of the blade. The computer then automatically adjusts elevation of the blade to reduce the elevation error.

Although the computer of the '663 patent may improve precision and accuracy of the earthmoving apparatus during a grading process, it does not consider removal parameters that can affect efficiency. In particular, the computer does not consider the amount of material to be removed during a single pass, the uniformity of the material, the size or shape of encountered obstacles, or the removal capacity of the earthmoving apparatus. Because the computer of the '663 patent does not consider these removal parameters, it may be inefficient at removing large amounts of material or non-uniform material from the tract of land.

The disclosed system is directed to overcoming one or more of the problems set forth above.

SUMMARY OF THE INVENTION

In one aspect, the present disclosure is directed to a control system for a machine operating at a worksite. The control system includes a controller configured to recognize a feature of the worksite from a topographic map of the worksite. The controller is also configured to determine at least one characteristic of the recognized feature, and determine a desired excavation entry point into a surface of the worksite based on the at least one characteristic.

In yet another aspect, the present disclosure is directed to a method of operating a machine at a worksite. The method includes recognizing a feature of the worksite from a topographic map and determining at least one characteristic of the recognized feature. The method also includes determining a desired excavation entry point into a surface of the worksite based on the at least one characteristic.

DETAILED DESCRIPTION

Figure 1:
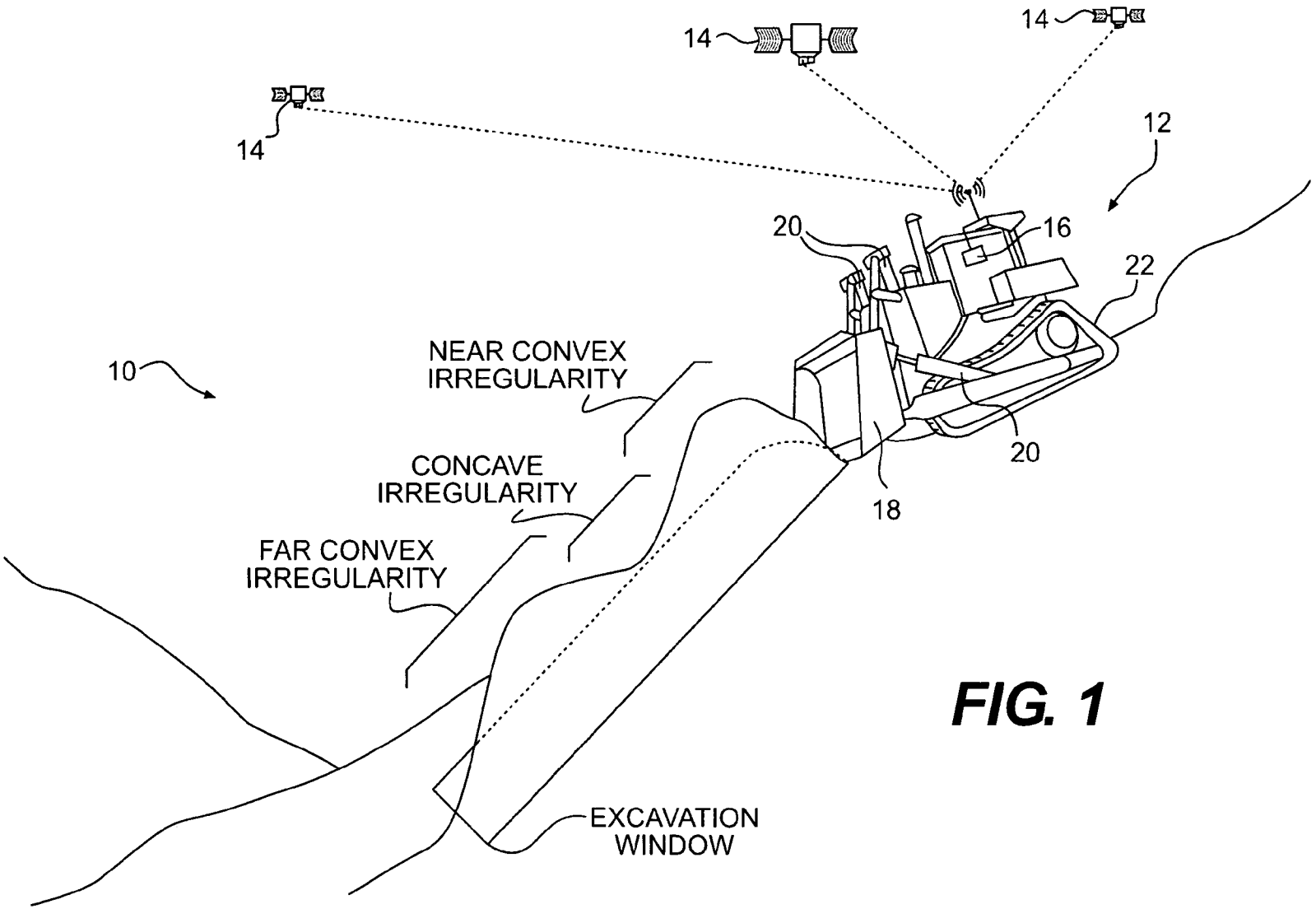
FIG. 1 is a pictorial illustration of an exemplary disclosed machine operating at a worksite.

FIG. 1 illustrates a worksite 10 with an exemplary machine 12 performing a predetermined task. Worksite 10 may include, for example, a mine site, a landfill, a quarry, a construction site, or any other type of worksite known in the art. The predetermined task may be associated with altering the current geography at worksite 10. For example, the predetermined tasks may include a grading operation, a leveling operation, a bulk material removal operation, or any other type of operation that results in alteration of the current geography at worksite 10. As machine 12 moves about worksite 10, a satellite 14 or other tracking device may communicate with an onboard control system 16 to monitor the movement of machine 12.

Machine 12 may embody a mobile machine that performs some type of operation associated with an industry such as mining, construction, farming, or any other industry known in the art. For example, machine 12 may embody an earth moving machine such as a dozer having a blade or other work implement 18 movable by way of one or more motors or cylinders 20. Machine 12 may also include one more traction devices 22, which may function to steer and/or propel machine 12.

Figure 2:
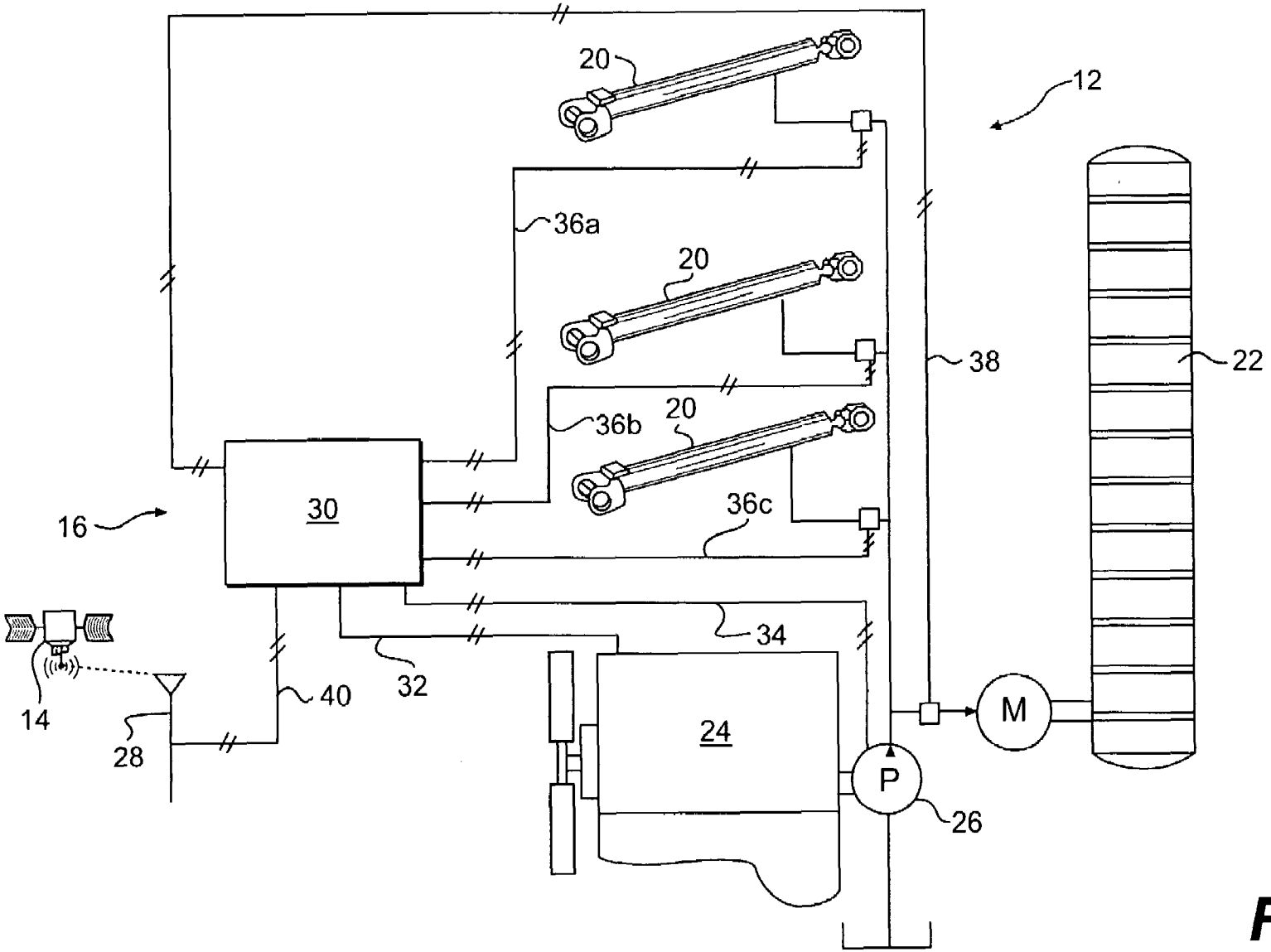
FIG. 2 is a diagrammatic illustration of an exemplary disclosed control system for use with the machine of FIG. 1.

As best illustrated in FIG. 2, control system 16 may include components that interact to affect operation of machine 12 in response to positional information received from satellite 14. In particular, control system 16 may include a power source 24, a means 26 for driving cylinders 20 and traction device 22, a locating device 28, and a controller 30. Controller 30 may be in communication with power source 24, driving means 26, cylinders 20, traction device 22, and locating device 28 via multiple communication links 32, 34, 36*a-c*, 38, and 40, respectively.

Power source 24 may include an engine such as, for example, a diesel engine, a gasoline engine, a gaseous fuel powered engine such as a natural gas engine, or any other type of engine apparent to one skilled in the art. Power source 24 may alternatively include a non-combustion source of power such as a fuel cell, a power storage device, an electric motor, or other similar mechanism. Power source 24 may be connected to drive means 26 via a direct mechanical coupling, an electric circuit, or in any other suitable manner.

Driving means 26 may include a pump such as a variable or fixed displacement hydraulic pump drivably connected to power source 24. Driving means 26 may produce a stream of pressurized fluid directed to cylinders 20 and/or to a motor associated with traction device 22 to drive the motion thereof. Alternatively, driving means 26 could embody a generator configured to produce an electrical current used to drive any one or all of cylinders 20 and traction device 22, a pneumatic pumping device, a mechanical transmission, or any other means for driving cylinders 20 and traction device 22.

Locating device 28 may embody an electronic receiver configured to communicate with satellites 14 to determine a location of itself relative to satellites 14. In particular, locating device 28 may receive and analyze high-frequency, low power radio signals from multiple satellites 14 to triangulate a 3-D position relative to the different satellites 14. A signal indicative of this position may then be communicated from locating device 28 to controller 30 via communication link 40. Alternatively, locating device 28 may embody an Inertial Reference Unit (IRU), a component of a local tracking system, or any other known locating device that receives or determines positional information associated with machine 12.

Controller 30 may include means for monitoring, recording, storing, indexing, processing, and/or communicating the location of machine 12 and for automatically controlling operations of machine 12 in response to the location. These means may include, for example, a memory, one or more data storage devices, a central processing unit, or any other components that may be used to run the disclosed application. Furthermore, although aspects of the present disclosure may be described generally as being stored in memory, one skilled in the art will appreciate that these aspects can be stored on or read from different types of computer program products or computer-readable media such as computer chips and secondary storage devices, including hard disks, floppy disks, optical media, CD-ROM, or other forms of RAM or ROM.

Controller 30 may generate a topographic representation of worksite 10 as machine 12 moves about worksite 10. In particular, as machine 12 moves about worksite 10, particularly during reverse travel of machine 12, the location information received via locating device 28 may be stored in matrix form within the memory of controller 30 and used to generate and continuously update a 3-D map of worksite 10. In one exemplary embodiment, controller 30 may generate and store within memory a single 3-D map of an area having an approximate width of machine 12 or work implement 18, and a predetermined length extending forward of machine 12, as machine 12 reverse travels over worksite 10. This area may be known as an excavation window of machine 12 that moves with machine 12 (referring to FIG. 1). In one example, the excavation window may have a width of about 5 meters and a length of about 25 meters. It is contemplated that controller 30 may alternatively receive from off-board machine 12 the 3-D map of worksite 10, from which controller 30 can operate.

Controller 30 may analyze the terrain of worksite 10 within the excavation window and make determinations and recommendations based on the analysis. In particular, controller 30 may be configured to recognize particular features of the terrain from the 3-D map, determine one or more characteristics of the recognized features, and recommend an excavation entry point of work implement 18 based on the determined characteristics. The features may include among other things, slope irregularities such as convex shaped obstacles or humps and concave shaped obstacles or valleys (referring to FIG. 1). Characteristics of the features may include a size of the irregularities such as a height, a calculated or measured base area, a calculated volume, or other size measurement. Based on the recognized feature and associated characteristics, controller 30 may determine the optimal entry point of work implement 18 into the terrain of worksite 10 to be, for example, at a point between the current position of machine 12 (e.g., the start of the excavation window) and a base of the irregularity, at the base of the irregularity, or at a location between the base of the irregularity and a peak of the irregularity.

The recommended excavation point of entry may be based on a capacity of machine 12. In particular, machine 12 may have a maximum capacity to move material that is fixed according to a size of work implement 18, a maximum rim-pull force of machine 12, a maximum safe operating slope of machine 12, a slope of the terrain within the excavation window, a material of worksite 10, or other such machine and worksite-related limitations. Controller 30 may compare the feature characteristics to the capacity of machine 12 and make entry point recommendations based on the capacity such that a maximum amount of material is moved during each excavation pass, without exceeding the machine's capacity to efficiently move material.

The 3-D map of worksite 10 may be used to autonomously alter the geography of worksite 10. In particular, controller 30 may autonomously control operations of machine 12 to engage work implement 18 with the terrain of worksite 10 at the recommended excavation entry points. Controller 30 may be in communication with the actuation components of cylinders 20 and/or traction device 22 to raise, lower, and/or orient machine 12 and work implement 18 such that work implement 18 engages the terrain of worksite 10 at the recommended excavation entry point. For example, controller 30 may communicate with power source 24, driving means 26, with various hydraulic control valves associated with cylinders 20, with transmission devices, and other actuation components of machine 12 to initiate, modify, or halt operations of cylinders 20 and traction device 22, as necessary or desired. It is contemplated that controller 30 may use locating device 28 and/or other such guidance and implement positioning systems to accurately control the operation of machine 12 such that work implement 18 enters the terrain of worksite 10 at the recommended excavation entry point. Alternatively, the 3-D map of worksite 10 may be displayed within a an operator station of machine 12 for manual completion of the excavation process, if desired. In this manner, controller 30 may provide for partial or full automatic control of machine 12.

Figure 3:
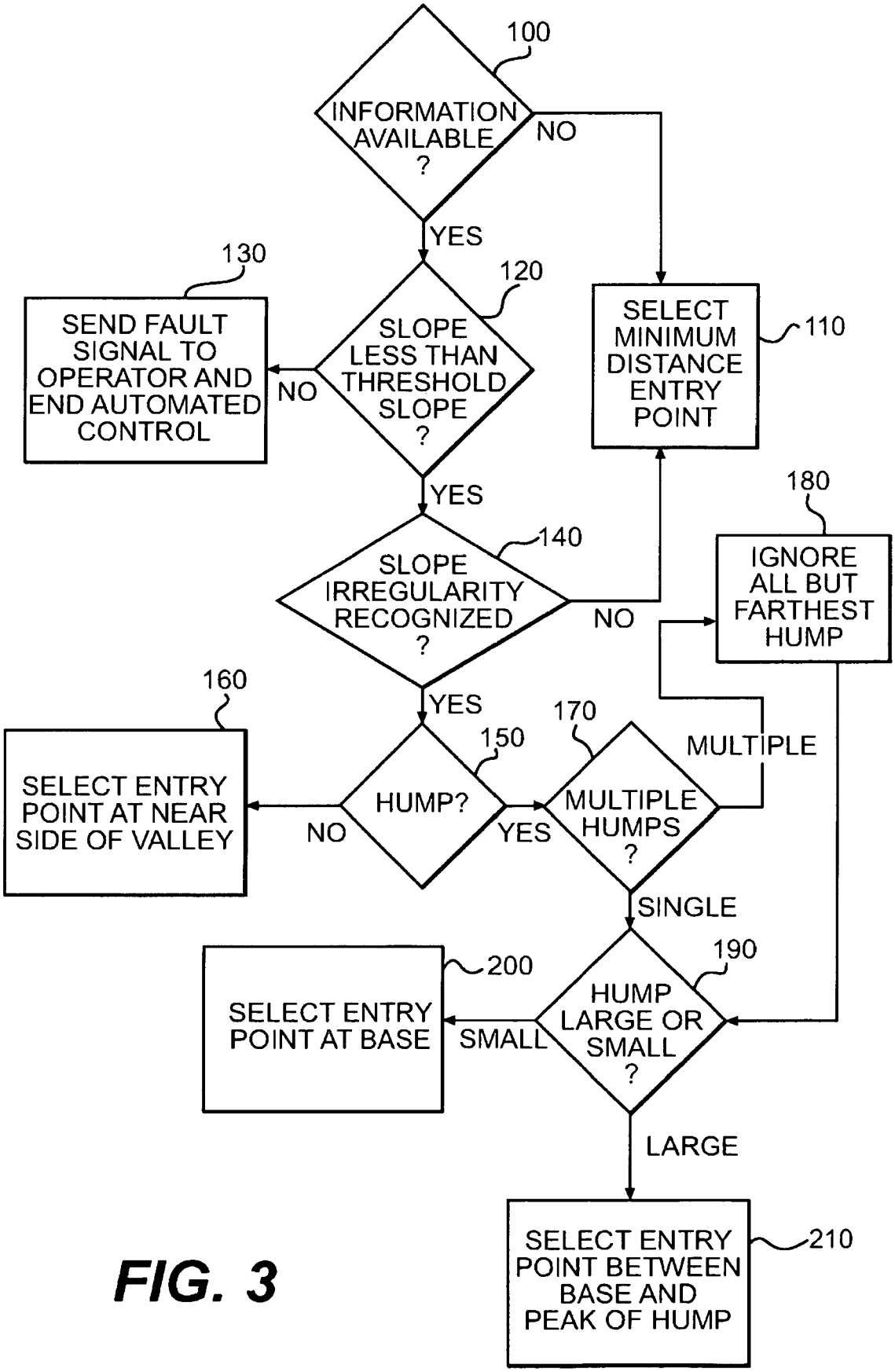
FIG. 3 is a flow chart illustrating an exemplary disclosed method of operating the control system of FIG. 2.

FIG. 3 illustrates an exemplary method of controlling machine 12. FIG. 3 will be discussed in the following section to further illustrate the disclosed control system and its operation.

INDUSTRIAL APPLICABILITY

The disclosed control system may be applicable to machines performing material moving operations where efficiency is important. In particular, the disclosed control system may determine and recommend an excavation entry point based on an automatically-generated 3-D map of a worksite and a maximum capacity of the machine that results in efficient excavation of material. The disclosed control system may also control the machine to autonomously engage a work implement at the recommended excavation entry point and remove any recognized irregularities. The operation of control system 16 will now be described.

As illustrated in the flowchart of FIG. 3, the first step in recommending an excavation entry point may include determining if there is enough terrain information available to make the recommendation (Step 100). In particular, if machine 12 is located to the rear of an excavation area over which machine 12 has not yet traveled and created a 3-D map, and no map of the terrain has been received from offboard of machine 12, controller 30 may have insufficient information to recommend an excavation entry point. In this situation, controller 30 may select a minimum distance in front of machine 12 for entry of work implement 18 into the terrain (Step 110). The minimum distance may correspond with a start of the excavation window. In one example, this minimum distance may be about 5 meters forward of work implement 18.

If sufficient data is available to plot a 3-D map of worksite 10 within the excavation window, controller 30 may determine if excavation within the window is physically possible and safe for an operator and machine. This determination may be made by comparing the general slope of the terrain within the excavation window to a maximum slope threshold (Step 120). If the slope of the terrain within the excavation window exceeds the maximum slope threshold, no entry point recommendations may be given to the operator of machine 12. Instead, a fault signal may be sent to the operator and automated control of machine 12 may be prevented or halted, if automated control has already commenced (Step 130). In this manner, safety of the operator and machine 12 may be ensured. It is contemplated that other conditions may be likewise trigger the fault condition, if desired.

If the slope of the terrain within the excavation window is acceptable (e.g., less than the maximum slope threshold), controller 30 may then determine if slope irregularities have been detected and recognized (Step 140). Controller 30 may detect a slope irregularity by comparing a measured terrain feature to a minimum size threshold value. If no irregularities are recognized and/or if the recognized irregularities are smaller than the minimum size threshold value, the terrain may be considered to have a substantially uniform slope. In this situation, the most efficient entry point for removal of material may be at the closest point to machine 12, and controller 30 may select the minimum distance entry location for recommendation (return to Step 110). In other words, if the distance to the first irregularity exceeds the length of the excavation window, it may be more efficient to immediately start removing material from the worksite rather than to start removing material at the first irregularity.

However, if controller 30 recognizes slope irregularities within the excavation window having a size greater than the minimum threshold value, controller 30 may then determine if the irregularities are humps (Step 150). Controller 30 may determine that the irregularity is a hump, if the shape of the irregularity is convex (e.g., has an apex higher in elevation than the base). Conversely, controller 30 may determine that an irregularity is a valley, if the shape of the irregularity is concave (e.g., has an apex lower in elevation than a base). If the irregularity is a valley, controller 30 may select an excavation entry point at a location between the current location of the machine 12 and a start of the valley with the goal to fill the valley and remove or reduce the concavity in preparation for the next excavation pass (Step 160). The selected excavation entry point may correspond with a volume of material between the deepest portion of the valley and the end of the excavation window that is equal to or less than a material removal capacity of machine 12. If multiple valleys are recognized within the window of excavation, they may be analyzed and removed in order of distance from machine 12 such that material from before the first valley or between valleys may be used to at least partially fill in the second or subsequent valleys.

If the irregularity is a hump, controller 30 may determine if multiple irregularities exist and respond accordingly (Step 170). For example, if multiple irregularities are recognized as humps within the same excavation window, all but the hump farthest from machine 12 may be ignored during the entry point recommendation process (Step 180). In other words, only the hump farthest from machine 12 may be analyzed and removed during the current excavation pass, while the remaining hump(s) may be passed over. By ignoring the closer humps and concentrating on the farthest hump, machine 12 may be kept from exaggerating the irregularities recognized within the terrain of the excavation window. That is, in some situations there may be insufficient distance between the multiple humps recognized within a single excavation window to remove the closer hump(s) without inadvertently increasing the size of the farthest hump. Instead, it may be most efficient to pass over the closer hump(s), completely remove the farthest hump, and then remove the closer hump(s) during subsequent excavation passes.

Before determining the excavation entry point associated with a recognized hump, controller 30 may first determine a size of the recognized hump. Controller 30 may determine the size of the recognized hump by comparing the hump's elevation above grade, its width, and/or its length to a predetermined hump size to classify the hump as either large or small (Step 190). The predetermined hump size may correspond to a material removal capacity of machine 12. For example, if the recognized hump is small and can be removed by machine 12 in a single excavation pass, the entry point of work implement 18 selected for recommendation may be at the base of the recognized hump (Step 200). However, if the recognized hump is large and would require multiple excavation passes for complete removal, the entry point selected for recommendation may at a location between the base of the hump and the peak of the hump (Step 210). This location may correspond to the material removal capacity of machine 12. If both a valley and a hump are recognized within the window of excavation, the hump may be engaged first so that the material from the hump may deposited within the valley to reduce the concavity thereof.

Because controller 30 may consider removal parameters when recommending excavation entry points, it may be efficient at removing large amounts of material or non-uniform material from worksite 10. In particular, because the excavation entry points may be recommended based on mapped terrain parameters such as location, shape, and size, and based on a removal capacity of machine 12, the recommended entry point may correspond with a maximum amount of material removable by machine 12 during an excavation routine or series of excavation passes. Further, by ensuring that machine 12 is not unnecessarily over or under loaded, machine 12 may be continuously operated at peak efficiency. In addition, because controller 30 may consider the predicted efficiency of machine 12 through subsequent excavation passes, each pass of machine 12 may be optimally efficient. That is, by working to flatten the terrain of worksite 10 while attempting maximum loading, subsequent excavation passes may have even higher removal efficiency than previous passes.

It will be apparent to those skilled in the art that various modifications and variations can be made to the disclosed control system. Other embodiments will be apparent to those skilled in the art from consideration of the specification and practice of the disclosed control system. It is intended that the specification and examples be considered as exemplary only, with a true scope being indicated by the following claims and their equivalents.

What is claimed is:

1. A control system for a machine operating at a worksite, comprising a controller configured to:

recognize a feature of the worksite from a topographic map of the worksite, the feature being a slope irregularity;

determine at least one characteristic of the recognized feature, the at least one characteristic including a shape of the slope irregularity; and determine a desired excavation entry point into a surface of the worksite based on the at least one characteristic and a known capacity of the machine.

2. The control system of claim 1, further including a positioning system configured to determine a three-dimensional location of the machine, wherein the controller is in communication with the positioning system and further configured to generate the topographic map of the worksite as the machine traverses the worksite in response to the determined location.

3. The control system of claim 1, wherein the controller is further configured to determine whether the slope irregularity is convex or concave in shape and to determine a size of the feature, and the excavation entry point is further determined based on the size of the feature.

4. The control system of claim 3, wherein, when the controller recognizes a slope irregularity, and determines that the slope irregularity is convex in shape and has a size less than a predetermined size, the controller determines the desired excavation entry point to be at a base of the convex slope irregularity.

5. The control system of claim 3, wherein, when the controller recognizes a slope irregularity, and determines that the slope irregularity is convex in shape and has a size greater than a predetermined size, the controller determines the desired excavation entry point to be at a location between the base of the convex slope irregularity and a peak of the convex slope irregularity.

6. The control system of claim 3, wherein, when the controller recognizes a slope irregularity and determines that the slope irregularity is concave in shape, the controller determines the desired excavation entry point to be at a location between the current location of the machine and a start of the concave slope irregularity.

7. The control system of claim 6, wherein the location is calculated based on the size of the concave slope irregularity.

8. The control system of claim 3, wherein, when the controller determines that the size of the slope irregularity is less than a predetermined size, the desired excavation point of entry is determined to be at a minimum distance from the current location of the machine.

9. The control system of claim 1, wherein the controller is further configured to:

recognize multiple slope irregularities at the worksite within a predetermined distance of the machine;

ignore all convex slope irregularities but the convex slope irregularity furthest from the machine when determining the at least one characteristic; and determine a desired excavation entry point associated with a convex slope irregularity before determining a desired excavation entry point associated with a concave slope irregularity.

10. The control system of claim 2, wherein:

the at least one characteristic includes a distance from the feature to the current location of the machine; and the desired excavation entry point is determined to be at a minimum distance from the current location of the machine, if the distance from the feature to the current location of the machine is greater than a predetermined distance.

11. A method of operating a machine at a worksite, comprising:

recognizing a feature of the worksite from a topographic map, including recognizing an irregularity in the slope of the worksite;

determining at least two characteristics of the recognized feature, including determining if the slope irregularity is convex or concave in shape and determining a size of the slope irregularity; and determining a desired excavation entry point into a surface of the worksite based on the at least two characteristic.

12. The method of claim 11, further including:

determining a 3-D location of a machine; and generating the topographic map of the worksite during travel of the machine based on the determined location of the machine.

13. The method of claim 11, further including:

setting the desired excavation entry point to be at the base of a convex slope irregularity, if it is determined that the size of the convex slope irregularity is less than a predetermined size;

setting the desired excavation entry point to be at a location between the base of the convex slope irregularity and a peak of the convex slope irregularity, if it is determined that the size of the convex slope irregularity is greater than a predetermined size; and setting the desired excavation entry point to be at a location between a current location of the machine and a start of the concave slope irregularity, the location being based on a size of the concave slope irregularity.

14. The method of claim 13, further including setting the desired excavation point of entry at a minimum distance from the current location of the machine, if it is determined that the size of the slope irregularity is less than a predetermined size.

15. The method of claim 11, further including:

recognizing multiple slope irregularities within a predetermined distance of the machine;

ignoring all convex slope irregularities but the convex slope irregularity furthest away from the machine when determining the at least two characteristic; and determining a desired excavation entry point associated with a convex slope irregularity before determining a desired excavation entry point associated with a concave slope irregularity.

16. A machine operating at a worksite, comprising:

a traction device configured to propel the work machine;

a positioning system configured to determine a three dimension location of the machine; and a controller in communication with the position system, the controller being configured to:

generate the topographic map of the worksite;

recognize a slope irregularity of the worksite from the topographic map;

determine a shape and a size of the slope irregularity; and determine a desired excavation entry point into a surface of the worksite based on the shape and the size of the slope irregularity and a known capacity of the machine.

17. The machine of claim 16, wherein:

the controller is further configured to determine whether the slope irregularity is convex or concave in shape;

when the controller recognizes a slope irregularity, and determines that the slope irregularity is convex in shape and has a size less than a predetermined size, the controller determines the desired excavation entry point to be at the base of the convex slope irregularity; and when the controller recognizes a slope irregularity, and determines that the slope irregularity is convex in shape and has a size greater than a predetermined size, the controller determines the desired excavation entry point to be at a location between the base of the convex slope irregularity and a peak of the convex slope irregularity.

18. The machine of claim 16, wherein:

the controller is further configured to determine whether the slope irregularity is convex or concave in shape; and when the controller recognizes a slope irregularity and determines that the slope irregularity is concave in shape, the controller determines the desired excavation entry point to be at a location between a current location of the machine and a start of the concave slope irregularity.

* * * * *